US011322287B2

(12) United States Patent
Findeisen

(10) Patent No.: US 11,322,287 B2
(45) Date of Patent: May 3, 2022

(54) ELECTRICAL DEVICE HAVING A PLURALITY OF COOLING UNITS

(71) Applicant: Siemens Energy Global GmbH & Co. KG, Munich (DE)

(72) Inventor: Joerg Findeisen, Dresden (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 490 days.

(21) Appl. No.: 16/340,263

(22) PCT Filed: Sep. 15, 2017

(86) PCT No.: PCT/EP2017/073249

§ 371 (c)(1),
(2) Date: May 6, 2019

(87) PCT Pub. No.: WO2018/065189

PCT Pub. Date: Apr. 12, 2018

(65) Prior Publication Data

US 2019/0318862 A1 Oct. 17, 2019

(30) Foreign Application Priority Data

Oct. 6, 2016 (DE) ..... 10 2016 219 406.2

(51) Int. Cl.
*H01F 27/10* (2006.01)
*H01F 27/02* (2006.01)
(Continued)

(52) U.S. Cl.
CPC ..... *H01F 27/10* (2013.01); *H01F 27/02* (2013.01); *H01F 27/28* (2013.01); *H01F 27/32* (2013.01);
(Continued)

(58) Field of Classification Search
CPC ..... H01F 27/10; H01F 27/02; H01F 27/28; H01F 27/32; H01F 27/402;
(Continued)

(56) References Cited

U.S. PATENT DOCUMENTS 2,479,373 A * 8/1949 Knotts ..... H01F 27/14 336/57
3,144,770 A * 8/1964 Sheely ..... H01F 27/402 374/152
(Continued)

FOREIGN PATENT DOCUMENTS

CN 2144881 Y 10/1993
CN 101355238 A 1/2009
(Continued)

*Primary Examiner* — Tuyen T Nguyen
(74) *Attorney, Agent, or Firm* — Laurence A. Greenberg; Werner H. Stemer; Ralph E. Locher

(57) ABSTRACT

An electrical device connects to a high-voltage network and has a vessel, which is filled with an insulating fluid, an active part, which is arranged in the vessel and which has a magnetizable core and partial windings for producing a magnetic field in the core, and a cooling apparatus for cooling the insulating fluid. The electrical device is economical and at the same time can be operated at higher temperatures. This is achieved by use of at least one thermal barrier, which delimits cooling spaces, in each of which at least one partial winding is arranged. The cooling apparatus has at least two cooling units and each cooling unit being configured to cool an associated partial winding.

13 Claims, 7 Drawing Sheets

(51) Int. Cl.
*H01F 27/28* (2006.01)
*H01F 27/32* (2006.01)
*H01F 27/40* (2006.01)

(52) U.S. Cl.
CPC ..... *H01F 27/402* (2013.01); *H01F 2027/406* (2013.01)

(58) Field of Classification Search
CPC ..... H01F 2027/406; H01F 27/2876; H01F 27/14; H01F 27/323; H01F 27/125
See application file for complete search history.

(56) References Cited

U.S. PATENT DOCUMENTS

| | | | | |
|---|---|---|---|---|
| 3,371,299 | A * | 2/1968 | Radkowski ..... | H01F 27/12 336/57 |
| 6,494,617 | B1 | 12/2002 | Stokes et al. | |
| 2013/0307654 | A1 | 11/2013 | Hyde et al. | |

FOREIGN PATENT DOCUMENTS

| | | | |
|---|---|---|---|
| DE | 19701269 | A1 | 7/1998 |
| EP | 0616341 | A1 | 9/1994 |
| EP | 2833378 | A1 | 2/2015 |
| JP | S4970135 | A | 7/1974 |
| JP | S55145315 | A | 11/1980 |

* cited by examiner

ELECTRICAL DEVICE HAVING A PLURALITY OF COOLING UNITS

BACKGROUND OF THE INVENTION

Field of the Invention

The invention relates to an electrical device for connecting to a high-voltage network, having a vessel which is filled with an insulating fluid, an active part which is arranged in the vessel and which has a magnetizable core and partial windings for generating a magnetic field in the core, and a cooling device for cooling the insulating fluid.

Such an electrical device is known to a person skilled in the art. Thus, for example, transformers or inductors which are connected to a high-voltage network each have a vessel which is generally filled with a mineral insulating oil as insulating fluid. In the case of a transformer, a low-voltage winding and a high-voltage winding are arranged in the vessel and are inductively coupled to one another via a magnetizable core. In addition to insulating the windings, the insulating fluid also serves to cool the transformer. For this purpose, the insulating oil heated during operation is guided, in order to remove the heat, via a cooling device built onto the outside of the vessel. The cooling is established in such a way that a maximum temperature of the insulating fluid is not exceeded, since otherwise the solid-material insulations of the transformer could be damaged.

Increasingly used in transformers are alternative insulating fluids, such as ester oils or silicone oils, which have a higher temperature resistance. These alternative insulating fluids ensure a higher fire safety and are, moreover, biodegradable. An improved environmental compatibility of insulating fluids is required in particular for offshore applications. By virtue of the improved thermal resistance of these alternative insulating fluids, the transformer can be operated at higher temperatures. In this connection, reference should be made to the standard IEEE 1276(1997).

In addition to the conventional insulating systems and materials, that is to say those which are currently predominantly used, so-called high-temperature insulations are known for electrical devices. However, these are cost-intensive. For this reason, so-called hybrid solutions have been proposed in which both high-temperature materials and customary materials have been used as insulation. For example, the barrier system of the insulation has conventional insulating materials, whereas the conductor winding insulation is obtained by high-temperature materials. However, the hybrid solutions are associated with the disadvantage that, in spite of the use of costly high-temperature insulating materials, the operating temperature of the insulating fluid, by virtue of the still used conventional insulating materials, lies considerably below the temperature which would be possible with the exclusive use of high-temperature insulating materials.

BRIEF SUMMARY OF THE INVENTION

It is therefore an object of the invention to provide an electrical device of the type stated at the outset which is cost-effective and can at the same time be operated at higher temperatures.

The invention achieves this object by means of at least one thermal barrier which delimits cooling spaces in each of which there is arranged at least one partial winding, wherein the cooling device has at least two cooling units, and each cooling unit is designed to cool an associated partial winding.

According to the invention, a thermal barrier, in interaction with at least two cooling units, ensures that at least two partial windings can be operated in different temperature sections, which are referred to here as cooling space temperatures. The thermal barrier ensures the formation of at least two cooling spaces which are connected to in each case one of the cooling units. Within the scope of the invention, the cooling units can thus set, in the cooling spaces connected thereto, different cooling space temperatures, that is to say different temperatures of the insulating fluid and/or of the windings. The cooling space temperature is expediently set in such a way that a maximum operating temperature predetermined for this cooling space is not exceeded. It is possible in this way to use different insulating materials in the cooling spaces. Moreover, it is possible, for example, for the partial winding which is arranged in a cooling space which allows higher cooling space temperatures to be designed to be low in insulating material.

Advantages arise within the scope of the invention if a partial winding which is designed for lower operating voltages is arranged in the cooling space in which higher cooling space temperatures are established during normal operation. Here, for example, the use of twisted mesh conductor windings is possible.

Furthermore, enameled copper wires which are coated with different insulating coatings and which can themselves withstand high temperatures are commercially available. This also applies, for example, to a wire having a coating of Pyre-ML polyimide, which is thermally resistant up to 220° C. By virtue of the small thickness of its coating layer, good heat transfer of the wire to the insulating fluid is ensured.

By contrast, other partial windings which are arranged in a cooling space in which the insulating fluid has a lower cooling space temperature are expediently equipped with the usual conventional, that is to say non-high-temperature-resistant, partial winding insulations or barrier systems.

Within the scope of the invention, the material of the insulating material is advantageously selected in dependence on the position of the respective insulation with respect to the so-called hotspot of the winding. A hotspot temperature is the hottest temperature, during operation of the electrical device, of the electrical conductor of the partial winding that is in heat-conducting contact with solid insulating material or the insulating fluid. Thus, for example, the conductor insulation is selected such that the material is not damaged even upon reaching the hotspot temperature. In other words, the conductor insulation can withstand the maximum winding temperature. By contrast, solid-material insulations having a certain spacing from the hottest points of the respective partial winding can, if the corresponding temperature gradient allows, be assigned to a lower thermal class.

Within the scope of the invention, the cooling device has at least two cooling units, wherein each cooling unit is designed to cool an associated cooling space. The use of two cooling units means that one of the cooling units can, for example, be connected to a partial winding via supply and discharge lines in such a way that the insulating fluid cooled by a cooling unit is circulated in a targeted manner via a selected partial winding and ensures that the required cooling space temperature is set in the cooling space.

Since, by virtue of the different voltages of the partial windings, in each case different vertical spacings from the yoke of the core are required, the winding base, which is built up in layers, can be used for the targeted supply of the insulating fluid to the selected partial winding. The insulating material disks of the base are expediently configured in such a way that a separation of the flow of the insulating fluid to the respective partial windings is provided.

By virtue of the separation of the flow of the insulating fluid through the cooling spaces, the cooling circuits can be fluidically completely separated from one another, or else partially use a common space. This space can in each case be situated fluidically upstream or downstream of the cooling spaces.

The thermal barrier advantageously forms an inlet opening which is connected to an outlet of the cooling device. Within the scope of the invention, this connection, or in other words the connection between the respective cooling unit and the inlet opening, can be configured in any desired manner. What is essential is that the main part of the insulating fluid flow exiting the respective cooling unit passes into the inlet opening.

Further advantages are afforded if the inlet opening is formed by a thermal barrier which at least partially defines a cooling space in which a high-voltage winding is arranged. By virtue of the higher voltage, the high-voltage winding is equipped with a more elaborate insulation. In order to use conventional materials there for said insulation, the high-voltage winding has to be more strongly cooled than the low-voltage winding which is insulated with high-temperature materials.

Within the scope of the invention, the fluid-filled cooling spaces separated from one another by the barrier system are expediently hydraulically connected to one another. This connection can occur via the connection to a common expansion vessel used by both cooling spaces, or by means of a partially open design of winding bases or winding tops.

According to a development in this respect, the thermal barrier encloses a partial winding at least in certain portions. The thermal barrier is, for example, of hollow-cylindrical design and arranged concentrically to at least one partial winding. According to this advantageous development, the thermal barrier forms a guide, or in other words cooling ducts, for the insulating fluid flow, with the result that the insulating fluid is guided via the partial winding. The cooling ducts can be configured in meandering fashion.

According to one expedient development in this respect, the thermal barrier is also an electrical barrier at least in certain portions.

The first partial winding is expediently a low-voltage winding, and a second partial winding is expediently a high-voltage winding. The two windings are arranged concentrically to one another and, for example, also to a core portion extending through the inner low-voltage winding. In other words, according to this embodiment of the invention, the electrical device is a transformer having concentric high-voltage and low-voltage windings as partial windings. The partial windings are advantageously configured as circumferentially closed cylindrical windings.

According to one variant in this respect, a first cooling unit is designed to cool the low-voltage winding, and a second cooling unit is designed to cool the high-voltage winding. As has already been stated, it is expedient here that the cooling device supplies the high-voltage winding with cooler insulating fluid such that it can be operated at lower temperatures. The low-voltage winding and the high-voltage winding are then again equipped with different insulating materials as partial winding insulation, these materials being able to withstand the different cooling space temperatures.

In principle, within the scope of the invention, the cooling spaces are hydraulically coupled to one another. According to one advantageous variant in this respect, the cooling space in which the high-voltage winding is arranged is hydraulically interconnected to the cooling space in which the low-voltage winding is arranged via an expansion vessel.

According to one variant, a cooling unit is designed as a closed circulating cooling system, wherein a pump is provided to circulate the insulating fluid. A second cooling unit is connected to the interior of the vessel, wherein the first cooling unit and the interior of the electrical vessel are connected to one another only via an expansion vessel. According to this variant, a hydraulic connection of the cooling spaces occurs exclusively via the expansion vessel which, on account of the temperature-dependent volume expansion of the insulating fluid, is absolutely required in any case.

The gaps between the individual barriers and between winding and vessel that are not required for cooling or for guiding the insulating fluid can advantageously be closed by means of shims in order to avoid bypasses.

As has already been stated, it is advantageous within the scope of the invention for the cooling device to have a supply line which forms an outlet opening arranged below the first partial winding and in particular below the high-voltage winding. According to this variant, the cooled insulating fluid exits the cooling device via the supply line and is introduced directly into the cooling space of the first partial winding, with the result that the first partial winding is more strongly cooled than the further partial windings which are arranged downstream of the first partial winding in the flow direction of the insulating fluid.

At least one cooling unit is advantageously connected to the winding base and/or winding top of a partial winding in such a way that the flows of the insulating fluid that are guided in each case via the cooling units during normal operation are separated from one another.

Each cooling unit expediently has at least one cooling register. The term cooling register is here also intended to encompass radiators. At least one or each cooling unit can be a passive cooling unit or else have a circulating pump for circulating the insulating fluid via a cooling register. The cooling register can be equipped with one or more fans or blowers.

According to a further variant, the cooling registers are connected to the vessel of the electrical device in such a way that they have different vertical spacings from a bottom surface defined by the bottom surface of the vessel. In other words, the cooling registers are fastened at different heights to the vessel. In a development in this respect, the cooling units are passive cooling units and have no circulating pump. In the case of passive cooling units, the speed of circulation of the insulating fluid via the cooling register is determined, in addition to other influencing variables, by the height offset between the center point of the hot fluid column in the cooling ducts of the respective partial winding and the center point of the cold fluid column of the respective cooling register. Since the partial windings are supported on the lower yoke of the core and thus have a fixed spacing from the bottom, this dependency of the speed of circulation on said height difference can also be described by way of the spacing of the respective cooling register from the bottom plane which is defined by the bottom of the vessel.

According to a preferred embodiment, the partial windings have different insulations. Thus, for example, a first partial winding has a high-temperature insulation, whereas a second partial winding and all further partial windings have customary insulations made of materials which are designed for lower temperatures. The term "insulation" here also comprises barrier systems and spacers which are used in addition to the insulation of the winding conductors.

Further components of the electrical device, for example tap changers, are assigned, corresponding to their respective admissible operating temperature, to one of the two cooling circuits flowing through the cooling spaces.

The cooling device advantageously has a control unit with temperature sensors, wherein the temperature sensors are designed to detect the temperature of a partial winding and/or to detect the temperature of the insulating fluid in a partial winding. The control unit is equipped, for example, with a threshold value for each cooling unit, with the result that the cooling power of the respective cooling unit can be controlled in dependence on the respective threshold value. The respective threshold value is determined in dependence on the temperature resistance of the insulating materials of the partial windings. If the temperature detected by the temperature sensors reaches the threshold value, the control unit activates either a circulating pump or else a fan of the respective cooling unit and thus increases the cooling power of said cooling unit.

The temperature sensors are designed to detect the temperature of a partial winding and/or to detect the temperature of the insulating fluid. Within the scope of the invention, the temperature sensors can therefore also directly detect the temperature of the winding conductor.

According to a further variant, at least one partial winding has a plurality of temperature regions in which insulating materials of different thermal loadability are arranged. In this connection, it can be advantageous if, in each upstream temperature region, insulating materials are arranged that have a lower thermal loadability than in downstream temperature regions which are situated downstream of the upstream temperature region in the flow direction of the insulating fluid.

In an expedient development in this respect, in each case a temperature sensor for measuring a hotspot temperature is arranged in at least two temperature regions and provides temperature measurement values on the outlet side which are compared with a threshold value predetermined in dependence on the insulating materials used in the respective temperature region, wherein a control signal is generated on the basis of this comparison. Depending on the design, said sensor can trigger a warning signal, cause shutdown, trigger a reduction in the load of the electrical device or else be used to control the cooling system.

According to the invention, the operation is made possible at higher temperatures, wherein a costly changeover for example of the insulating material-rich winding parts of a high-voltage winding to high-temperature insulating materials can be prevented. Moreover, a higher current density in the winding conductors and hence a considerable reduction in the overall size are possible. Within the scope of the invention, an increase in the temperature of the insulating fluid leads to a considerable increase in the temperature difference to the external cooling medium, such as air or water, for example. Consequently, the effectiveness of the cooling increases considerably, with the result that the electrical device according to the invention can be configured to be more compact.

On account of the high viscosity of ester- and silicone-based insulating fluids, there further arise flow-related and cooling-related advantages during operation at higher temperatures. Optimization of the losses for normal load becomes possible, with provision of a high overload leeway.

For certain applications, the high temperature spread of the insulating liquid allows the effective use of external evaporative coolers and coolers based on heat pipes.

A plurality of fluidically connected temperature regions in the cooling space are advantageously equipped with sensors for measuring the hotspot temperature of the partial winding in the respective temperature region, wherein the signals of each of these temperature sensors are each assigned dedicated threshold values for triggering control functions which are tailored to the thermal class of the insulating materials used in the respective temperature regions of the partial winding.

BRIEF DESCRIPTION OF THE SEVERAL VIEWS OF THE DRAWING

Further expedient embodiments and advantages of the invention form the subject matter of the following description of exemplary embodiments of the invention with reference to the figures of the drawing, in which identical reference signs refer to identically acting components and in which FIGS. 1 to 7 schematically illustrate different exemplary embodiments of the electrical device according to the invention in a partially sectioned side view.

DESCRIPTION OF THE INVENTION

Figure 1:
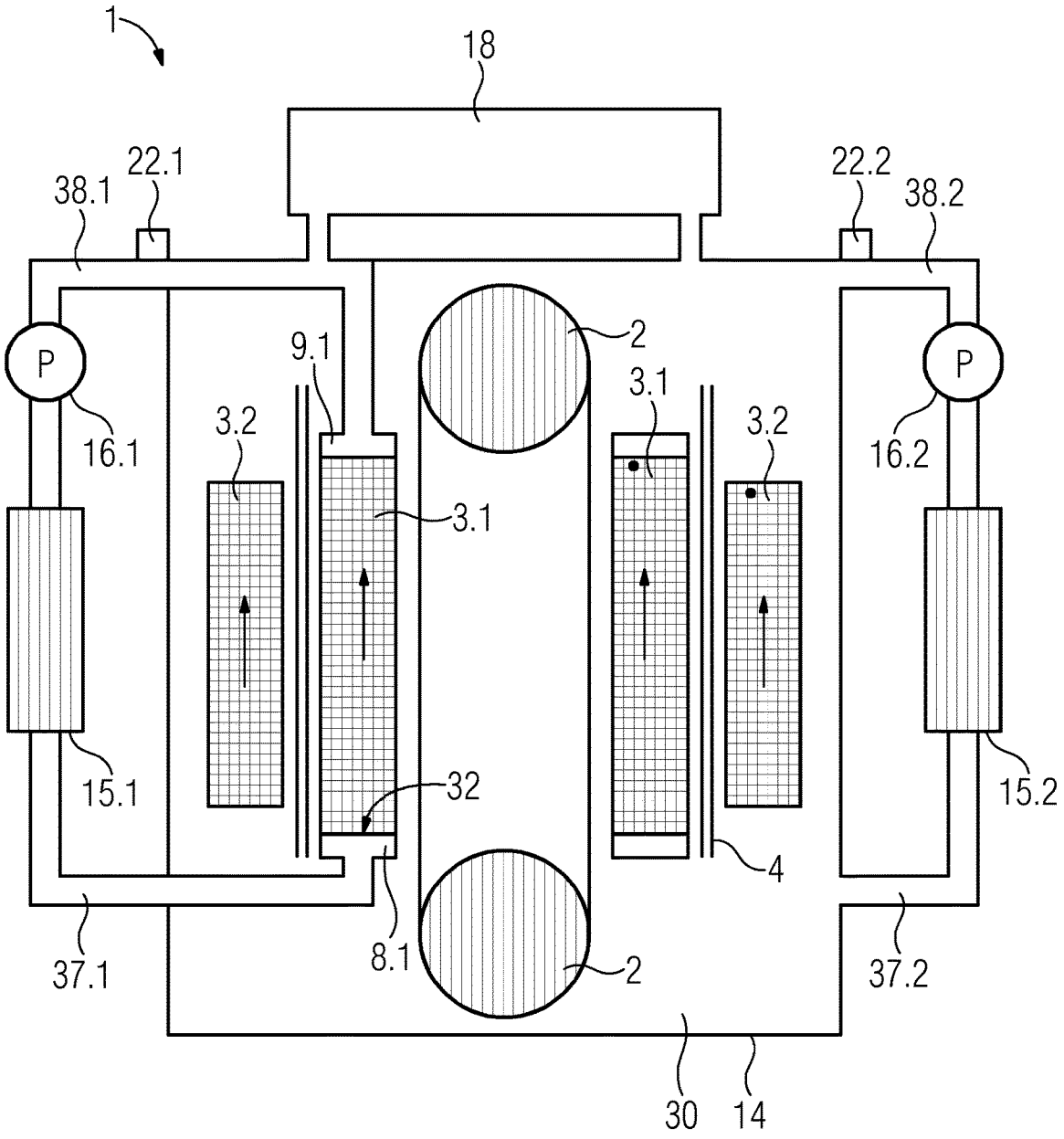

FIG. 1 shows a first exemplary embodiment of the electrical device 1 according to the invention in a sectioned side view, wherein the electrical device is configured as a transformer 1. The transformer 1 has a vessel 14 in which a magnetizable core 2, a low-voltage winding 3.1 and a high-voltage winding 3.2, each as partial winding within the sense of the invention, are arranged concentrically to one another. Said windings 3.1, 3.2 are of hollow-cylindrical design. The high-voltage winding 3.2 can be connected to a high-voltage network via a connection (not shown in the figure), while the low-voltage network 3.1 can be connected to a distribution network or a load via a connection line (not shown either). The high-voltage and low-voltage winding 3.1, 3.2 are inductively coupled to one another via the magnetizable core 2, with the result that the high-voltage winding 3.2 induces a voltage in the low-voltage winding 3.1, or vice versa.

The vessel 14 is filled with an insulating fluid 30 and, in the present case, with a commercially available ester. A thermal barrier 4 is arranged between the high-voltage winding 3.2 and the low-voltage winding 3.1. The thermal barrier 4 is circumferentially closed and likewise of hollow-cylindrical design. Here, it completely encloses the likewise cylindrical low-voltage winding 3.1. Above the vessel 14 there is arranged an expansion vessel 18 which serves to take up the temperature-induced volume fluctuations of the insulating fluid 30.

In order to cool the partial windings 3.1 and 3.2, a cooling device is provided which has two cooling units, wherein a first cooling unit has a cooling register 15.1, a circulating pump 16.1 and a temperature sensor 22.1, a supply line 37.1 and a return line 38.1. The second cooling unit has a cooling register 15.2, a circulating pump 16.2, a temperature sensor 22.2, a supply line 37.2 and a return line 38.2. The supply line 37.1 has an outlet opening 32 which is arranged below the radially inner low-voltage winding 3.1. An inlet opening of the return line 38.1 is directly connected to a winding top 9.1 of the winding 3.1. The winding top 9.1 is fluidically sealed, by which is meant that the flow of the insulating fluid 30 is guided by the winding top. The return line 38.1 is connected via a connection line to the expansion vessel 18, which in turn is connected via a second connection line to the interior of the vessel 14 of the transformer 1. The supply line 37.2 of the second cooling unit opens by way of its outlet opening directly in the side wall of the vessel 14. The return line 38.2 is connected close to the upper edge of the vessel. The inner wall of the thermal barrier 4 thus delimits a first cooling space in which the low-voltage winding 3.1 is arranged. The outer wall of the thermal barrier 4 delimits, together with the vessel 14, a second cooling space in which the high-voltage winding 3.2 is situated. According to the exemplary embodiment illustrated in FIG. 1, the insulating fluid 30 cooled by the first cooling unit 15.1, 16.1, 37.1, 38.1 is guided via the sealed winding base 8.1 directly to the low-voltage winding 3.1 and from there directly back to the cooling register 15.1. In this exemplary embodiment, the hydraulic coupling of the cooling spaces occurs only via the expansion vessel 18. Different cooling space temperatures are established in the cooling spaces. The insulations are each adapted to these cooling space temperatures.

The temperature sensors 22.1 and 22.2 are each connected to a control unit (not shown in the figure) via a signal line. If the temperature of the insulating fluid 30 that is detected by the temperature sensors 22.1 or 22.2 exceeds a threshold value predetermined for the respective partial winding 3.1 or 3.2, the control unit increases the power of the circulating pump and thus the power of the respective cooling unit. The threshold values have been determined in dependence on the thermal class of the insulating materials of the respective partial windings.

Figure 2:
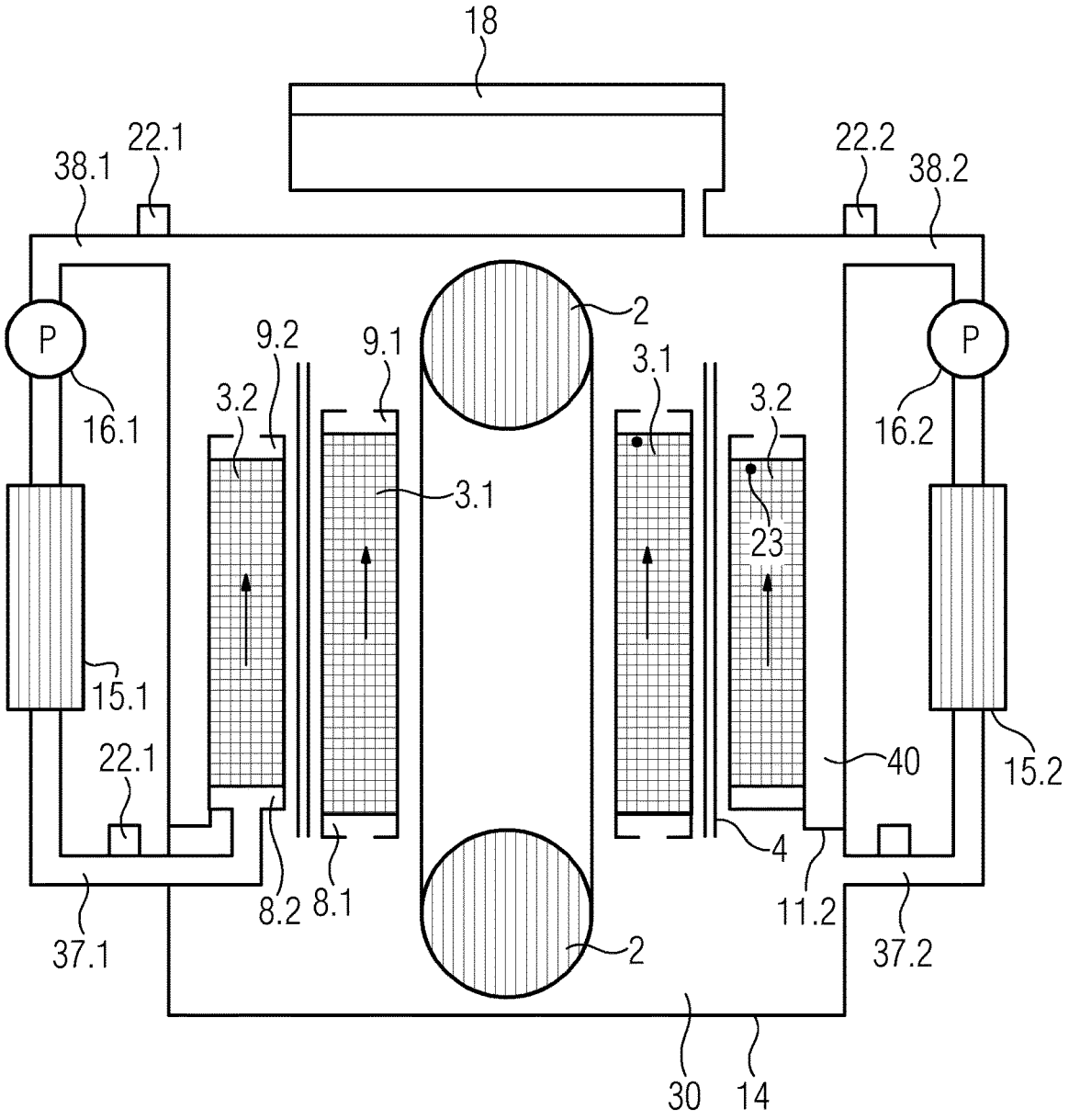

FIG. 2 shows an exemplary embodiment of the electrical device 1 according to the invention, in which the hydraulic coupling of the cooling circuits occurs via the upwardly open winding tops 9.1, 9.2 of the partial windings 3.1, 3.2. Mixing of the insulating fluid 30 occurs above the partial windings 3.1 and 3.2. The insulating fluid 30 is differently cooled in the cooling units each assigned to a partial winding 3.1, 3.2. Thus, a higher cooling effort is implemented in the cooling circuit for the partial winding 3.2 whose winding conductors are equipped with an elaborate high-voltage insulation. In other words, the insulating fluid 30 is cooled to a lower temperature.

The cooling space of the partial winding 3.1 and the core 2 are incorporated in the cooling circuit formed via the cooler 15.2.

The partial winding 3.1 with lower requirements on its withstand voltage, which thus has a small number of insulating materials by comparison with the other partial winding, is equipped with an insulation of a higher thermal class and can thus be operated at higher temperature. Equipping this partial winding with high-temperature insulating materials requires only low costs. Within the scope of the invention, it is expedient to operate partial windings with a comparatively low withstand voltage at a higher temperature than the partial windings with a high withstand voltage.

Designing the core 2 for higher temperatures requires only a very small effort since no moldings are required and an electrical field loading does not have to be taken into consideration. Accordingly, the core 2 is likewise exposed to higher operating temperatures.

The supply of the insulating fluid 30, which is cooled in separate cooling units, to the partial windings 3.1 and 3.2 occurs via the winding base 8.1, 8.2 of the respective partial winding 3.1 or 3.2.

The winding base 8.1, 8.2, each built up in layers, is used for the separate supply of the insulating fluid 30 to the partial windings 3.1, 3.2 separated by the thermal barrier. The insulating material disks (not illustrated in detail here) of the respective winding base 8.1, 8.2 are designed in such a way that a separation of the flow of the insulating fluid 30 to the respective partial windings 3.1, 3.2 is provided.

In order to decouple the fluid flows, the winding bases 8.1 and 8.2 are sealed with respect to one another. Furthermore, at least one connection line 37.1 is provided which extends between the cooling unit 15.1, 16.1 and the winding base 8.2, with the result that the flow of the cooled insulating fluid is sealed with respect to the interior of the vessel 14. In the exemplary embodiment, the cooling register 15.1 is directly connected to the winding base 8.2 via a pipeline 37.1.

In the exemplary embodiment, the spaces 40 between the partial windings 3.2 and the vessel 14 that are not required for cooling or for guiding the insulating fluid 30 are closed by means of shims 11.2 in order to avoid bypasses.

Figure 3:
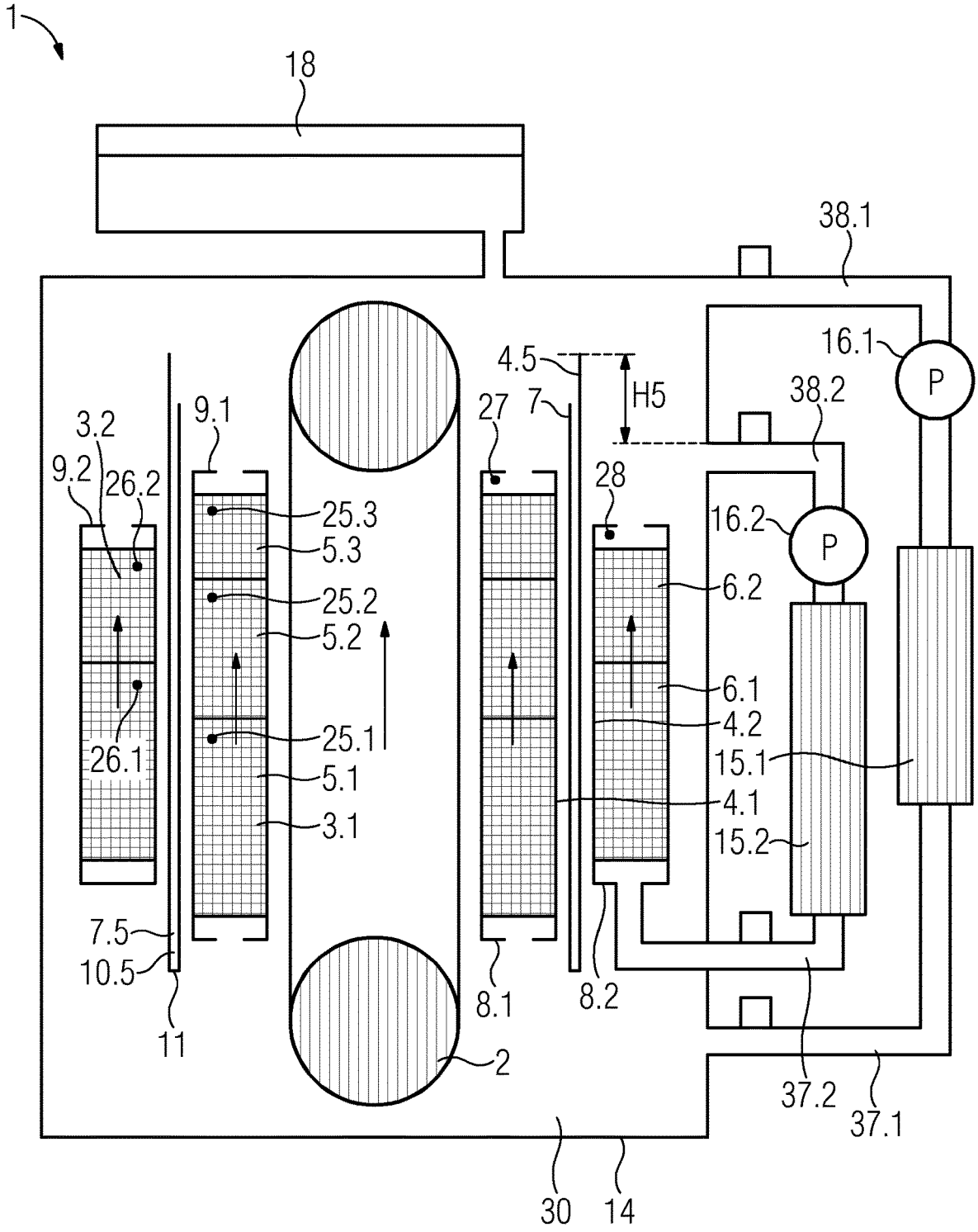

FIG. 3 shows a further exemplary embodiment of the invention having two cooling spaces separated by the thermal barrier 4. The thermal barrier 4 comprises cylindrical portions 4.1 and 4.2 and a separating wall 4.5. In the exemplary embodiment shown, the thermal barrier 4 produced from a thermally insulating material brings about thermal and fluidic decoupling of the radially outer partial winding 3.2 from the inner partial winding 3.1 and the core 2 of the transformer 1. In other words, the decoupling is achieved by the separation of the insulating fluid flows of the two cooling circuits by means of the thermal barrier 4.

In the exemplary embodiment shown, an electrical barrier 7 is integrated as a portion into the barrier 4. For thermal separation of the insulating fluid flow, the winding base 8.2 of the partial winding 3.2 is fluidically connected to the supply line 37.2, which leads to the cooler register 15.2 of the second cooling unit that is arranged outside of the vessel. The radially inner partial winding 3.1 and the cooling ducts of the core 2 are open toward the fluid space of the vessel 14. Furthermore, the supply line 37.1 of the first cooling register 15.1 is connected to the vessel 14 at a height below the lower edge of the partial winding 3.1. The inner partial winding 3.1 and the core 2 are thus supplied with cooled insulating fluid 30 by "free", that is to say nonguided, flow. In addition to a winding base 8.1 or 8.2, each partial winding has a winding top 9.1, 9.2. Each winding top 9.1 and 9.2 is open toward the fluid space of the vessel 14. Through the openings of their winding top 9.1, 9.2, in the exemplary embodiment the two cooling spaces are hydraulically connected to one another via the vessel interior, that is to say the fluid space of the vessel 14.

In order to take up the thermally induced volume fluctuations of the insulating fluid 30, the interior of the vessel 14, and thus the two cooling spaces, are connected to the expansion vessel 18. Thermal stratification of the insulating fluid 30 occurs within said fluid spaces of the transformer 1 as a result of the temperature dependency of the density of the insulating fluid 30. This thermal stratification is increased by a high viscosity of the insulating fluid 30 used and the very low flow velocities in the large cross section. In the specific exemplary embodiment, this effect is used for thermal separation of the two cooling circuits. For this purpose, according to the invention, the connection of the return line 38.2 to the cooling register 15.2 is arranged below the connection of the return line 38.1 to the cooling register 15.1. In order to avoid mixing of the insulating fluid 30 heated to different degrees, a further portion 4.5 of the thermal barrier 4 is provided in the usually open region above the windings. This portion 4.5 projects above the electrical barrier 7. In the exemplary embodiment, the vertical spacing H5 from the upper edge of the portion 4.5 of the thermal barrier 4 to the return line 38.2 is a multiple of the flow-delimiting diameter of the return line 38.2. This prevents a situation in which considerably more highly heated insulating fluid 30 which has flowed through the low-voltage winding 3.1 passes into the return line 38.2.

In order to avoid the formation of bypasses, potential undesired flow ducts 10.5, for example between portions 7.5 of the barrier system 4 and the electrical barrier 7, are completely or partially closed at one of their ends by means of shims consisting of insulating material.

In the exemplary embodiment shown, the partial windings 3.1 and 3.2 within the cooling spaces form temperature regions 5.1, 5.2, 5.3 or 6.1, 6.2 which are situated vertically above one another and which are equipped with an electrical insulation consisting of insulating materials which have a thermal loadability which differs from temperature region to temperature region. Thus, the thermal loadability of the insulating materials in the temperature region 5.1 through which insulating fluid 30 first flows is less than the insulating materials of the temperature regions arranged downstream in the flow direction. Moreover, it is also possible to use insulating materials of different thermal classes, at least partially, within the temperature regions. Thus, the thermal loadability of an insulating material can be less if it maintains the necessary spacing from the hottest point of the temperature region, that is to say, for example, from a certain winding layer. It is thus possible, for example, for a gradation of the thermal class to occur within a temperature region 5.1 depending on whether the insulating material is used as conductor insulation, spacer, potential control ring or barrier.

This arrangement can be applied for a wide variety of insulating materials and hence different temperature regions. An exemplary assignment of the thermal classes to the temperature regions illustrated in the exemplary embodiment is indicated below. In the exemplary embodiment, use is made of an insulating fluid based on an ester.

Design example for a winding arrangement according to FIG. 3 (thermal classes of the insulating materials in accordance with EN 60085:2008)

| | Temperature region | | | | |
|---|---|---|---|---|---|
| | 5.1 | 5.2 | 5.3 | 6.1 | 6.2 |
| Conductor insulation | B (130° C.) | F (155° C.) | H (180° C.) | E (120° C.) | B (130° C.) |
| Spacer | E (120° C.) | B (130° C.) | F (155° C.) | A (105° C.) | E (120° C.) |
| Barrier system/potential control rings | A (105° C.) | E (120° C.) | B (130° C.) | A (105° C.) | A (105° C.) |

In this connection, the term "spacer" is intended to encompass radial and axial spacers, such as, for example, bars, riders, interlayers or the like. The term "barrier system" is intended to include barriers, angle rings, caps, disks, insulating cylinders or the like.

The gradation of the thermal efficiency of the insulating materials can also be undertaken within the thermal classes in accordance with EN 60085, a large number of possibilities existing here, with, for example, a gradation in increments of less than 10 K also being possible.

Furthermore, in the exemplary embodiment, the hotspots of the temperature regions are equipped with thermal sensors 25.1, 25.2, 25.3, 26.1 and 26.2 which are each connected to a control unit (not shown in the figure). In the exemplary embodiment, furthermore, a sensor 27, 28 for measuring the maximum temperature of the insulating liquid 30 is arranged in the region of the respective outlet opening in the winding top 9.1 or 9.2.

In FIG. 3, five temperature regions 5.1, 5.2, 5.3, 6.1, 6.2 are thus provided which are each equipped with insulating materials from 3 different thermal classes. Thus, different admissible maximum temperatures are obtained for each temperature region. The insulating liquid 30 must not achieve the admissible maximum temperature for the insulating fluid in the temperature regions arranged ahead in the flow progression, since otherwise the temperature gradient from the winding to the insulating fluid 30 in the winding regions through which flow subsequently passes becomes too low for sufficient cooling.

Since, as described, the admissible temperatures are different in the different temperature regions, it makes sense for the temperatures in the temperature regions to be monitored separately. In the exemplary embodiment, the hotspots of all temperature regions are therefore equipped with thermal sensors, and the signals are sent to a control unit. Each of these signals is assigned a threshold value which is tailored to the thermal class of the insulating materials of the corresponding winding region. If one of the temperature signals exceeds the threshold value assigned thereto, a control signal is generated. Depending on the design, it can trigger a warning signal, bring about shutdown, trigger a reduction in the load of the electrical device or else be used to control the cooling system.

The signal of each temperature sensor 25.1, 25.2, 25.3, 26.1, 26.2 is preferably assigned different threshold values for cooling system control, warning and triggering.

Figure 4:
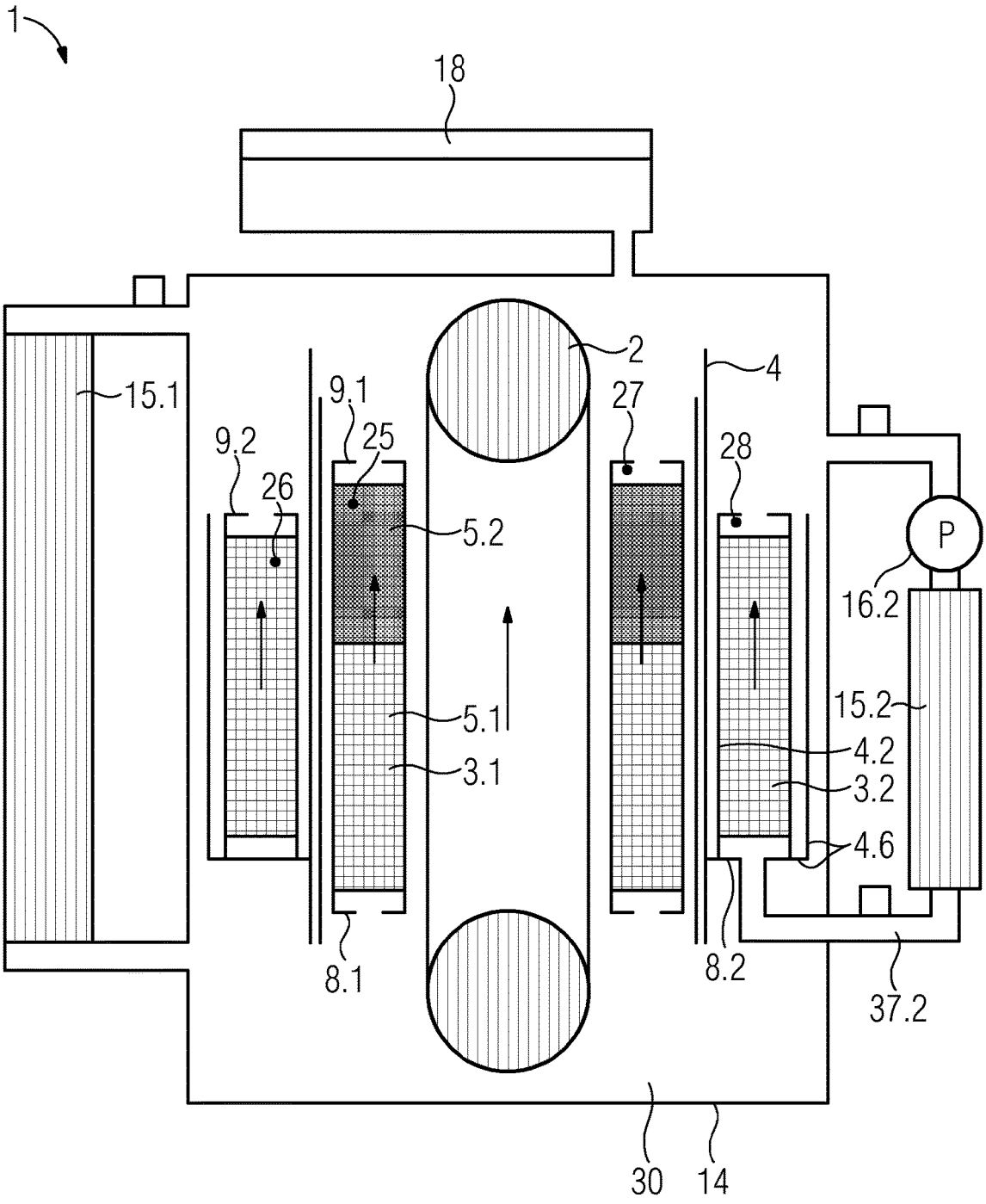

FIG. 4 shows a further exemplary embodiment in which a cooling unit is configured as an active cooling unit and has a circulating pump 16.2, whereas the other cooling unit is a passive cooling unit 15.1 in which the insulating fluid 30 is circulated via the cooling register 15.1 on the basis of a temperature difference which arises.

In the exemplary embodiment shown, the winding 3.2 having the higher high-voltage requirements, that is to say the winding with a high proportion of insulating materials and insulating parts which are to be manufactured in an elaborate manner, is cooled in a forced manner by the active cooling unit 15.2, 16.2. The partial winding 3.2 is again enclosed by cylindrical portions 4.1 of the thermal barrier 4. The cooled insulating fluid 30 is supplied via the fluidically sealed winding base 8.2, which is connected to the cooling unit 15.2 and the pump 16.2 via the supply line 37.2.

The vessel 14 is also connected to the cooling register 15.1. The more strongly cooled partial winding 3.2 is provided with insulating materials of a low thermal class. Since, during operation of a transformer 1 shown, large differences in the temperatures of the insulating fluid 30 are established inside and outside of the thermal barrier 4, additional barrier portions 4.6 are provided which avoid a fluid flow directly on the wall of the barrier 4.2 and thus reduce the thermal influencing of the partial winding 3.2. In the exemplary embodiment, for this purpose, there are provided, directly following the barrier portion 4.2, electrical barriers and angle rings with shims which prevent the fluid flow within the duct between the barriers.

In this exemplary embodiment, only the partial winding 3.1 has two temperature regions 5.1 and 5.2. With regard to the temperature regions, the statements pertaining to FIG. 6 correspondingly apply here.

Figure 5:
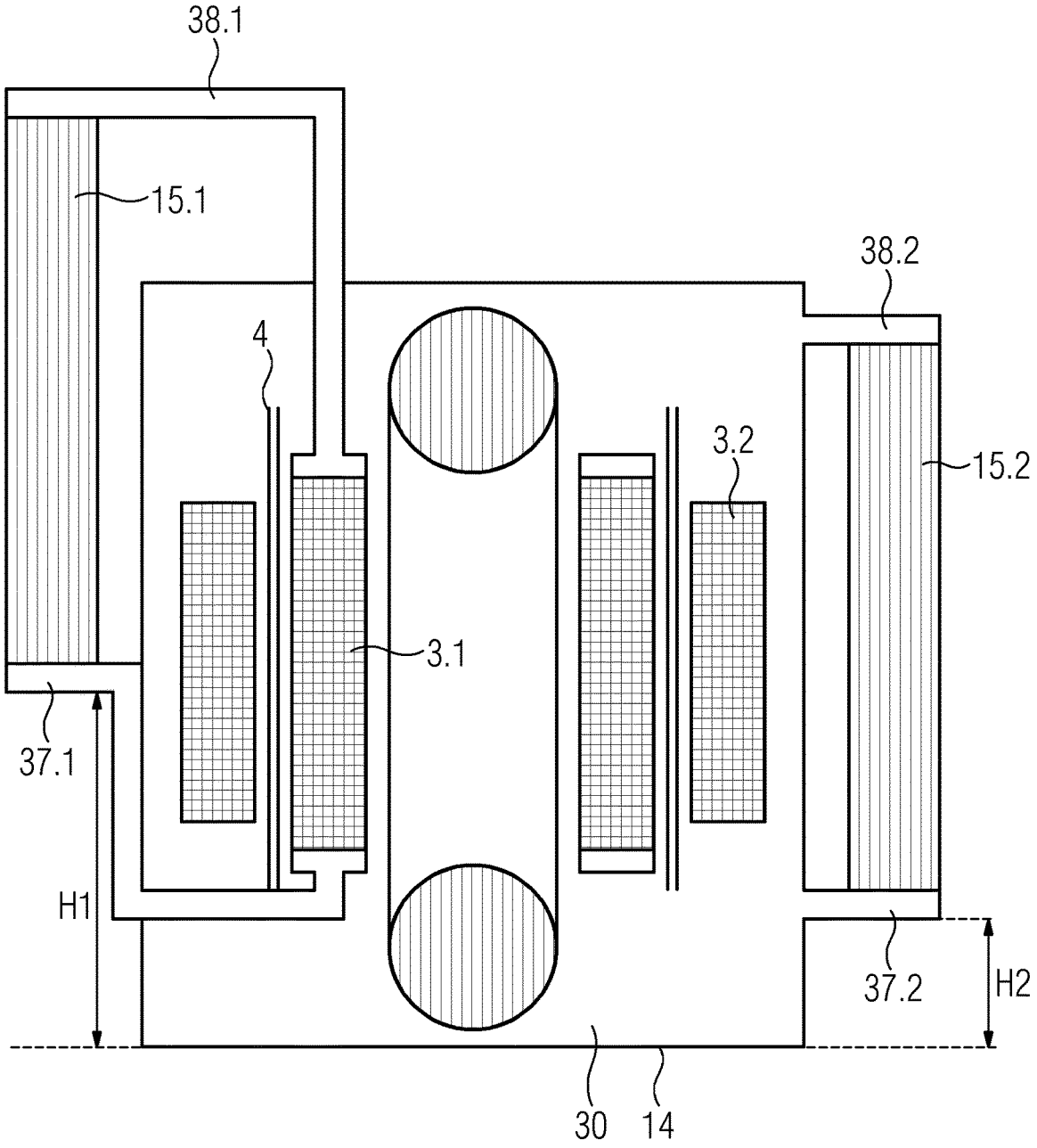

FIG. 5 illustrates an exemplary embodiment of a transformer 1 having natural cooling (ONAN cooling). Here, the movement of the insulating liquid is caused by thermal buoyancy. The insulating fluid 30 heated by the partial windings 3.1, 3.2 rises on account of its lower density with respect to the insulating liquid 30 of the further surroundings of the winding and is replaced by cold insulating liquid 30 flowing in from below. The weight difference between the hot liquid column in the winding ducts and the cooler liquid column in the cooling register 15.1 or 15.2 produces a pressure difference which serves as driving force for the fluid circuit. Moreover, a higher geometric arrangement of the cold insulating fluid column of the cooling register leads to an increase in the pressure difference that drives the cooling medium flow. This effect is used in the exemplary embodiment to supply a winding 3.1 with an increased pressure and thus a higher volumetric flow of the insulating liquid. For this purpose, the cooling register 15.1 which supplies the winding 3.1 with cooled insulating fluid is arranged at a greater spacing from the center of the winding 3.1 than the cooling register 15.2 which is provided to supply the partial winding 3.2 and the core 2.

On account of the fixed spacing of the partial winding from a bottom plane defined by the bottom of the vessel, this height offset is here described by the spacing of the respective cooling register from said bottom plane. These different height positions are therefore considered here as a vertical spacing H1, H2 of the respective cooling register 15.1, 15.2 from the bottom plane which is defined by the bottom of the vessel 14.

H1 is greater than H2. Since the two partial windings 3.1 and 3.2 are supported on the lower yoke of the core 4, the centers thereof are situated approximately at the same height. Accordingly, the spacing between the center of the first cooler 15.1 and the center of the first winding 3.1 is greater than the spacing between the center of the second cooler 15.2 and the center of the second winding 3.2.

If this driving force becomes too high, a strong secondary flow of the insulating fluid 30 between partial winding and vessel wall of the transformer 1 then occurs on account of the flow resistance in the winding, said flow reducing the effectiveness of the cooling. In order to avoid this, in the exemplary embodiment the cooled insulating fluid 30 is supplied to the winding 3.1, which is connected to the cooling unit 15.1 arranged higher, via the winding base 8.1 which is fluidically sealed for this purpose.

The insulating fluid flow is thus adapted to the different operating temperatures of the two partial windings and their different flow resistances.

Within the scope of the invention, the cooling registers 15.1 and/or 15.2 can be equipped with fans.

Figure 6:
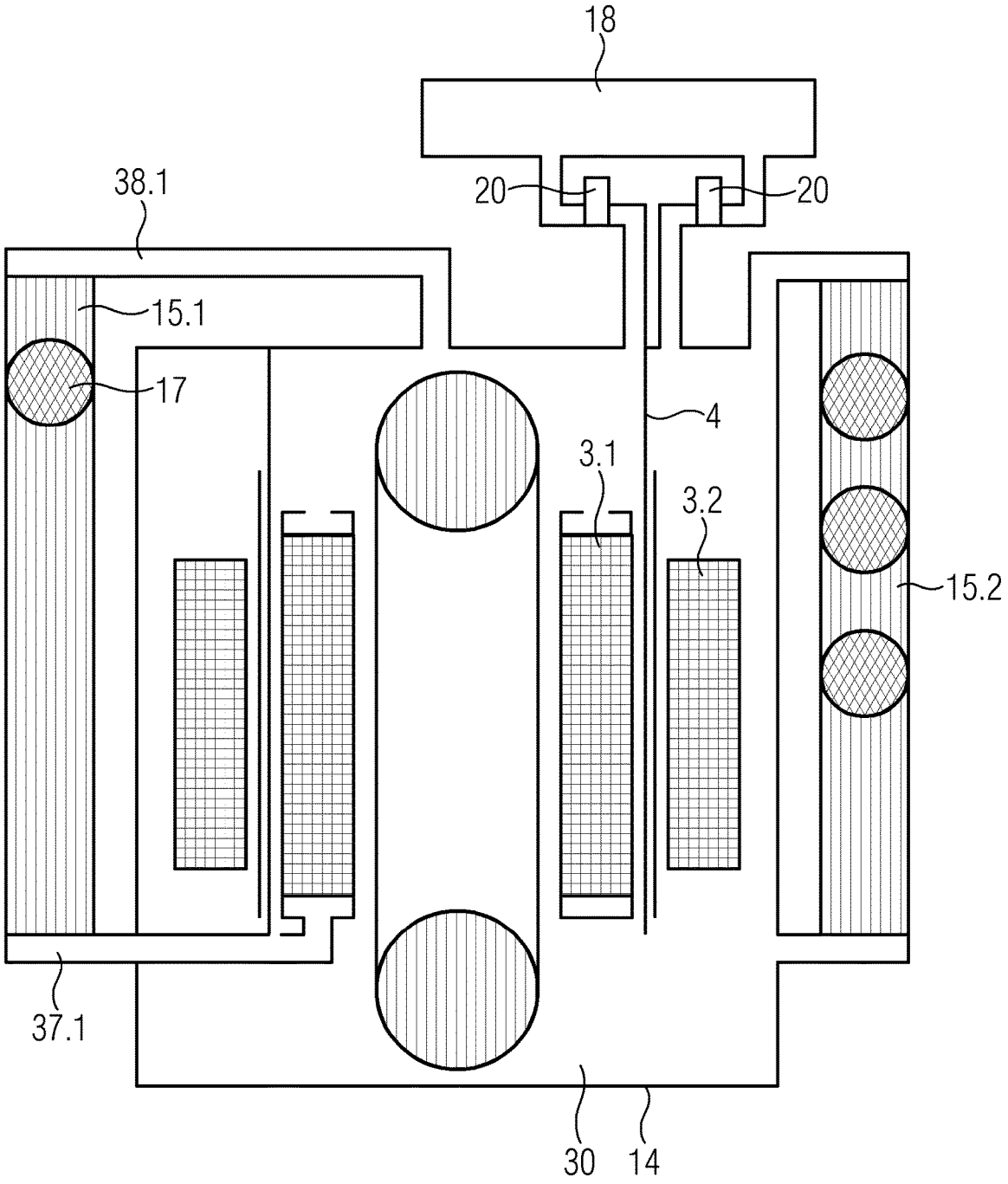

FIG. 6 shows a further exemplary embodiment of the electrical device 1 according to the invention, which differs from the exemplary embodiment shown in FIG. 5 to the effect that the cooling registers 15.1 and 15.2 are equipped with fans or blowers 17. Here, the cooling register 15.1 and the cooling register 15.2 have a different number of fans 17. Moreover, the cooling registers 15.1 and 15.2 are situated at the same height. The supply line 37.1 of the first cooling unit is arranged exactly below the first partial winding 3.1, that is to say the low-voltage winding. By contrast with the exemplary embodiments shown in FIGS. 1 to 5, the thermal barrier 4 extends as far as the upper wall of the vessel 14, the return line 38.1 connecting the cooling space within the thermal barrier 4 to the cooling register 15.1. The first cooling unit therefore again forms a closed circulating cooling circuit, wherein the hydraulic coupling between the first cooling space and the second cooling space, which is defined by the outer wall of the thermal barrier 4 and the inner wall of the vessel 14, is achieved via the expansion vessel 18. For this purpose, the corresponding connection lines are provided.

Since, in the exemplary embodiment, the thermal and fluidic separation of the windings also continues above the windings, the two cooling spaces are each equipped with a dedicated Buchholz relay 20 in order to monitor gas accumulations in the two cooling spaces.

With increasing loading of the transformer 1, the temperatures in the two partial windings 3.1, 3.2 increase differently and are first cooled without fan assistance (ONAN cooling). The fans 17 are activated or controlled differently at different temperatures for the two partial systems for each cooling circuit.

In the exemplary embodiment, the cooling unit for the cooling space with the partial winding which is equipped with insulating materials of a lower thermal class is already switched to fan operation at a lower temperature than the cooler for the partial winding with insulating materials of a higher thermal class. In order to be able to operate the two partial windings at full load, the cooling register 15.2 has a larger number of fans 17 than the cooling register 15.2.

Figure 7:
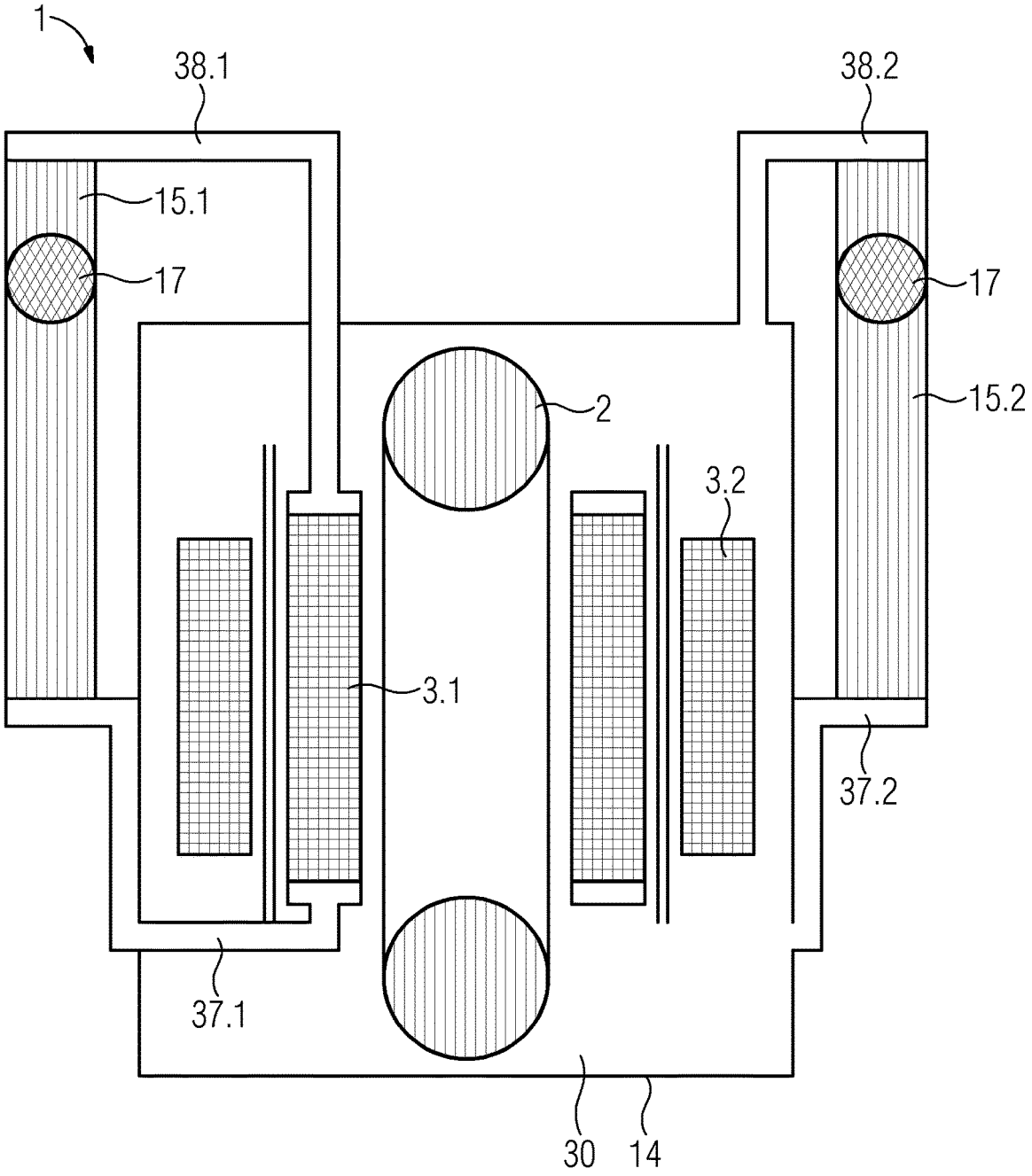

FIG. 7 shows a further exemplary embodiment of the invention of the electrical device 1 according to the invention, which substantially corresponds to the exemplary embodiment according to FIG. 1, although the cooling units 15.1 and 15.2 are each designed as passive cooling units, with the result that neither of the cooling units has a circulating pump.

Further components (not shown here) of the electrical device 1, for example tap changers, are assigned, corresponding to their respectively admissible operating temperature, to one of the two cooling spaces.

The invention claimed is:

1. An electrical device for connecting to a high-voltage network, the electrical device comprising:

a vessel filled with an insulating fluid;

an active part disposed in said vessel and having a magnetizable core and partial windings for generating a magnetic field in said magnetizable core, at least one of said partial windings having temperature regions in which insulating materials of different thermal loadability are disposed;

at least one thermal barrier delimiting cooling spaces and in each of said cooling spaces is disposed at least one of said partial windings; and a cooling device for cooling said insulating fluid, said cooling device having at least two cooling units, and each of said cooling units is configured to cool an associated one of said partial windings, said cooling device further having a control unit with temperature sensors, said temperature sensors configured to detect a temperature of a partial winding of said partial windings and/or to detect a temperature of said insulating fluid in said partial winding, wherein in each case one of said temperature sensors for measuring a hotspot temperature is disposed in at least two of said temperature regions and provides temperature measurement values on an outlet side which are compared with a threshold value predetermined in dependence on said insulating materials used in a respective one of said temperature regions, wherein a control signal is generated on a basis of a comparison.

2. The electrical device according to claim 1, wherein:

said cooling device has an outlet; and said thermal barrier forms at least one inlet opening which is connected to said outlet of said cooling device.

3. The electrical device according to claim 1, wherein said thermal barrier encloses said partial winding at least in certain portions.

4. The electrical device according to claim 1, wherein said thermal barrier is an electrical barrier at least in certain portions.

5. The electrical device according to claim 1, wherein said partial windings include a first partial winding being a low-voltage winding, and a second partial winding being a high-voltage winding, wherein said first and second partial windings are disposed concentrically to one another and to said magnetizable core which extends through said low-voltage winding being an inner low-voltage winding.

6. The electrical device according to claim 5, wherein said two cooling units include a first cooling unit configured to cool said low-voltage winding and a second cooling unit configured to cool said high-voltage winding.

7. The electrical device according to claim 6, further comprising an expansion vessel, a cooling space in which said high-voltage winding is disposed is hydraulically coupled to a cooling space in which said low-voltage winding is disposed via said expansion vessel.

8. The electrical device according to claim 6, wherein at least one of said first and second cooling units is connected to a winding base and/or a winding top of one of said partial windings in such a way that flows of said insulating fluid that are in each case guided via said first and second cooling units during normal operation are separated from one another.

9. The electrical device according to claim 6, wherein each of said first and second cooling units has a cooling register.

10. The electrical device according to claim 9, wherein said cooling registers have different vertical spacings from a bottom plane defined by a bottom surface of said vessel.

11. The electrical device according to claim 1, wherein said partial windings have different partial winding insulations.

12. An electrical device for connecting to a high-voltage network, the electrical device comprising:

a vessel filled with an insulating fluid;

an active part disposed in said vessel and having a magnetizable core and partial windings for generating a magnetic field in said magnetizable core, at least one of said partial windings having temperature regions in which insulating materials of different thermal loadability are disposed;

at least one thermal barrier delimiting cooling spaces and in each of said cooling spaces is disposed at least one of said partial windings;

a cooling device for cooling said insulating fluid, said cooling device having at least two cooling units, and each of said cooling units is configured to cool an associated one of said partial windings, said cooling device further having a control unit with temperature sensors, said temperature sensors configured to detect a temperature of a partial winding of said partial windings and/or to detect a temperature of said insulating fluid in said partial winding, wherein a plurality of fluidically connected said temperature regions in a cooling space are equipped with said temperature sensors for measuring a hotspot temperature of said partial winding in a respective temperature region, and signals of each of said temperature sensors are each assigned dedicated threshold values for triggering control functions which are tailored to a thermal class of said insulating materials used in said respective temperature regions of said partial winding.

13. An electrical device for connecting to a high-voltage network, the electrical device comprising:

a vessel filled with an insulating fluid;

an active part disposed in said vessel and having a magnetizable core and partial windings for generating a magnetic field in said magnetizable core, said partial windings including a first partial winding being a low-voltage winding, and a second partial winding being a high-voltage winding, said first and second partial windings disposed concentrically to one another and to said magnetizable core extending through said low-voltage winding being an inner low-voltage winding;

at least one thermal barrier delimiting cooling spaces and in each of said cooling spaces is disposed at least one of said partial windings; and a cooling device for cooling said insulating fluid, said cooling device having at least two cooling units, and each of said cooling units is configured to cool an associated one of said partial windings, said two cooling units including a first cooling unit configured to cool said low-voltage winding and a second cooling unit configured to cool said high-voltage winding;

a controller;

sensors and dedicated sensors; and said partial windings are fluidically and thermally separated partial windings and have said dedicated sensors for temperature monitoring of a winding temperature and/or said sensors for measuring a maximum insulating fluid temperature in thermally separated said cooling spaces of said partial windings, and said sensors are connected to said control unit which is provided with means for monitoring an observance of admissible temperatures of said partial windings and/or of said insulating fluid, which are different for each cooling space, and for independently controlling said cooling units respectively assigned to a cooling space.

* * * * *